US006169564B1

(12) United States Patent
Tsukagoshi et al.

(10) Patent No.: US 6,169,564 B1
(45) Date of Patent: Jan. 2, 2001

(54) OPTICAL PRINTHEAD

(75) Inventors: Hisashi Tsukagoshi; Norio Nakajima, both of Tokyo (JP)

(73) Assignee: Oki Data Corporation, Tokyo (JP)

( * ) Notice: Under 35 U.S.C. 154(b), the term of this patent shall be extended for 0 days.

(21) Appl. No.: 09/238,044

(22) Filed: Jan. 27, 1999

(30) Foreign Application Priority Data

Feb. 2, 1998 (JP) ..... 10-021036

(51) Int. Cl.[7] ..... B41J 2/45
(52) U.S. Cl. ..... 347/238; 347/242; 347/130
(58) Field of Search ..... 347/238, 130, 347/242, 241, 244, 245, 256, 257; 250/208.1; 346/107 R

(56) References Cited

U.S. PATENT DOCUMENTS 5,023,442 * 6/1991 Taniguchi et al. ..... 250/208.1
5,321,429 * 6/1994 Ono et al. ..... 347/238

FOREIGN PATENT DOCUMENTS 06-064-227 * 3/1994 (JP) .

* cited by examiner

*Primary Examiner*—N. Le
*Assistant Examiner*—Lamson D. Nguyen
(74) *Attorney, Agent, or Firm*—Rabin & Champagne, PC

(57) ABSTRACT

A circuit board holds a line of light emitting elements mounted thereon. The light emitting elements are at a predetermined height from the surface of the circuit board. A rod lens array longitudinally extends and forms images of the light emitting elements on a photoconductive body such that the images and the light emitting elements form pairs of conjugate points with respect to the rod lens array. A holder holds the rod lens array relative to the light emitting elements. Supporting members are mounted to the holder at locations along a length of the rod lens array and hold the rod lens array relative to the circuit board so that the images form a substantially straight line on the photoconductive body. Each of supporting member supports a part of the rod lens array relative to the circuit board. The supporting member has a first reference portion and a second reference portion, the first reference portion abutting a lower surface of the rod lens array and the second reference portion abutting the surface of the circuit board on which the light emitting elements are carried. The supporting member of different heights may be assembled to the holder along the length of the rod lens array so that any warp and/or distortion of the base is accommodated, thereby allowing images of light emitting elements are on a very straight line.

10 Claims, 13 Drawing Sheets

FIG.10

$L_0$=8.41mm TC=18.7mm

| VARIATION | SLA SUPPORTING MEMBER | K |
|---|---|---|
| $+0.3<\delta\leq+0.5$ | 901 | 4.95 |
| $+0.1<\delta\leq+0.3$ | 902 | 5.05 |
| $-0.1<\delta\leq+0.1$ | 903 | 5.15 |
| $-0.3<\delta\leq-0.1$ | 904 | 5.25 |
| $-0.5<\delta\leq-0.3$ | 905 | 5.35 |

OPTICAL PRINTHEAD

FIELD OF THE INVENTION

The present invention relates to an optical printhead for use in, for example, an electrophotographic printer.

DESCRIPTION OF THE RELATED ART

An LED head is one type of an optical print head. For example, Japanese Patent Preliminary Publication (KOKAI) No. 6-64227 discloses one such type of printhead. The printhead includes a rod lens array, a printed circuit board, and a base. The rod lens array (e.g., Selfoc Lens Array or SLA, manufactured by NIPPON ITA GARASU) focuses light emitted from LEDs on the surface of a photoconductive body. The printed circuit board has LED chips and driver ICs mounted thereon. The driver ICs selectively drive the LED chips to emit light in accordance with print data. The base serves as a heat sink and a datum or reference for positioning the aforementioned structural elements.

The LED printhead must be longer than the width of a print medium. For example, if the maximum size of the print paper that a printer can accept is A4 (210 mm×297 mm), then the length of the LED printhead should be in the range from 260 to 280 mm. If the maximum size is A3 (297 mm×420 mm), then the length of the LED printhead should be in the range from 350 to 370 mm. Thus, the SLA, holder, LED array unit, and base are all necessarily long.

An LED printhead must be designed to form a line of uniformly focused spots of light on the surface of a photoconductive body along the length of the photoconductive body. The line should be accurately straight so that the line of spots do not wave or is not curved.

The base is rigid and serves as a reference, so that the entire structure of the printhead is sufficiently rigid and straight. The resin-molded holder is mounted together with the SLA and LED array unit to the base for integral construction, so that the overall structure of the print head is accurately straight. The SLA has a lateral end surface abutting an SLA-supporting portion formed on the holder, the lateral end surface being in the same plane as the light incident surfaces of the rod lenses of the SLA. As a result, a line of the light incidence surfaces of the rod lenses is parallel to a row of LED array units. Conventionally, special care had to be taken in order to form an accurately straight base and a precision SLA-supporting portion so that the lines of focal points of the SLA is accurately straight and therefore the line of spots focussed on the surface of the photoconductive body.

The LED printhead of the aforementioned construction is placed to oppose the photoconductive body and forms a line of spots of light focussed on the photoconductive body, the line not waving or not being out of the straight.

However, in order to obtain an adequately straight line of focused spots of images, the SLA must not deviate more than several tens microns, preferably less than 20 microns, from a true straight line. This implies that the SLA-supporting portion must not deviate more than several tens microns from the true straight line. The holder is molded from a resin. A long molded article such as one used in an LED printhead suffers from distortion and warp resulting from partial shrinkage of the article after molding. Therefore, a highly accurate mold is needed. Stringent dimensional requirements imposed on the article and the mold lead to a high cost of the mold. In the mass production of the article, the mold must be frequently maintained so as to ensure high dimensional accuracy.

SUMMARY OF THE INVENTION

An object of the invention is to provide a printhead in which a line of focussed images of LEDs is very straight.

A circuit board holds a line of a plurality of light emitting elements mounted thereon. The light emitting elements are at a predetermined height from the surface of the circuit board. A rod lens array (SLA) longitudinally extends and forms images of the light emitting elements on a photoconductive body such that the images and the light emitting elements form pairs of conjugate points with respect to the rod lens array. A holder holds the rod lens array relative to the light emitting elements.

A plurality of supporting members are mounted to the holder at a plurality of locations along a length of the rod lens array (SLA) and hold the rod lens array relative to the circuit board so that the images form a substantially straight line on the photoconductive body. Each of the plurality of supporting members substantially independently supports the rod lens array relative to the circuit board. The supporting members has a first reference portion and a second reference portion, the first reference portion abutting a lower surface of the rod lens array (SLA) and the second reference portion abutting the surface of the circuit board on which the light emitting elements are carried.

The supporting member of different heights may be assembled to the holder along the length of the rod lens array so that any warp and/or distortion of the base is accommodated, thereby allowing images of light emitting elements are on a very straight line.

Further scope of applicability of the present invention will become apparent form the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 10 shows a table which lists the SLA supporting members 901–905;

DETAILED DESCRIPTION OF THE INVENTION

First embodiment

A first embodiment of the invention will be described in detail with respect to the accompanying drawings.

Figure 1:
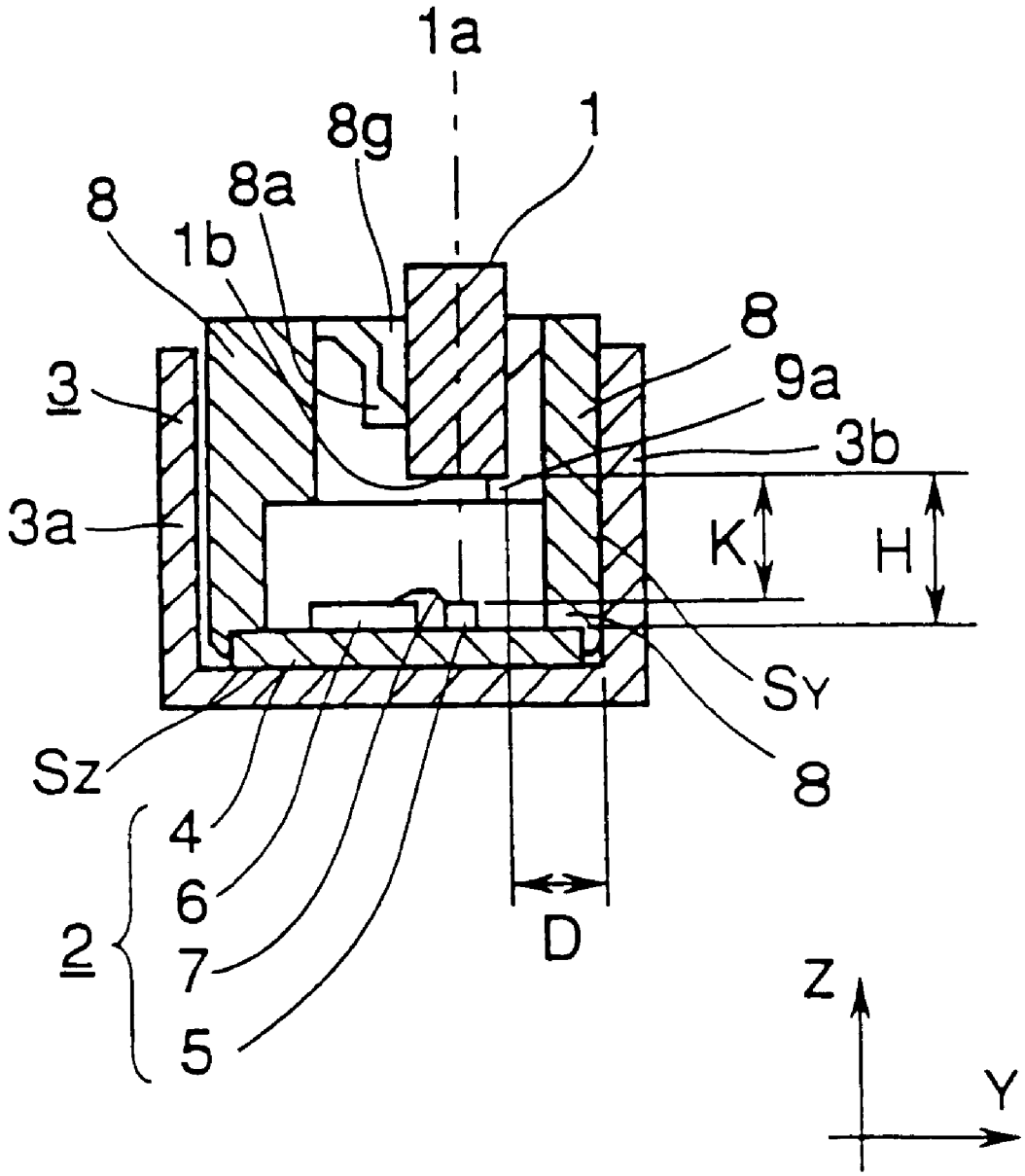
FIG. 1 is a cross-sectional view of an LED printhead according to the first embodiment, taken along lines I—I of FIG. 2.
Figure 2:
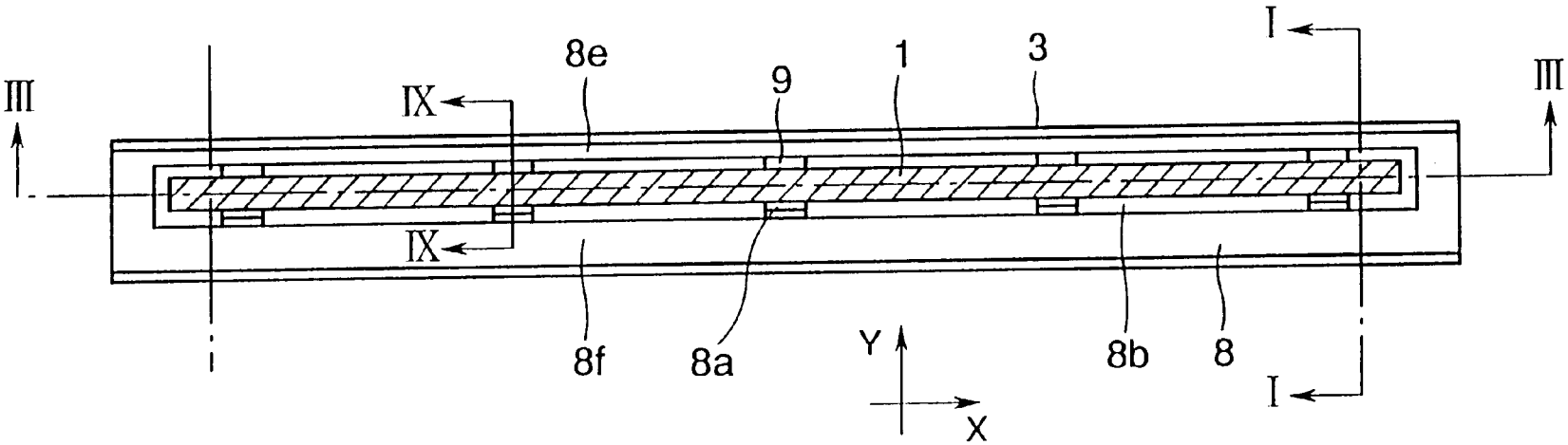
FIG. 2 is a top view of the LED printhead of the first embodiment.
Figure 3:
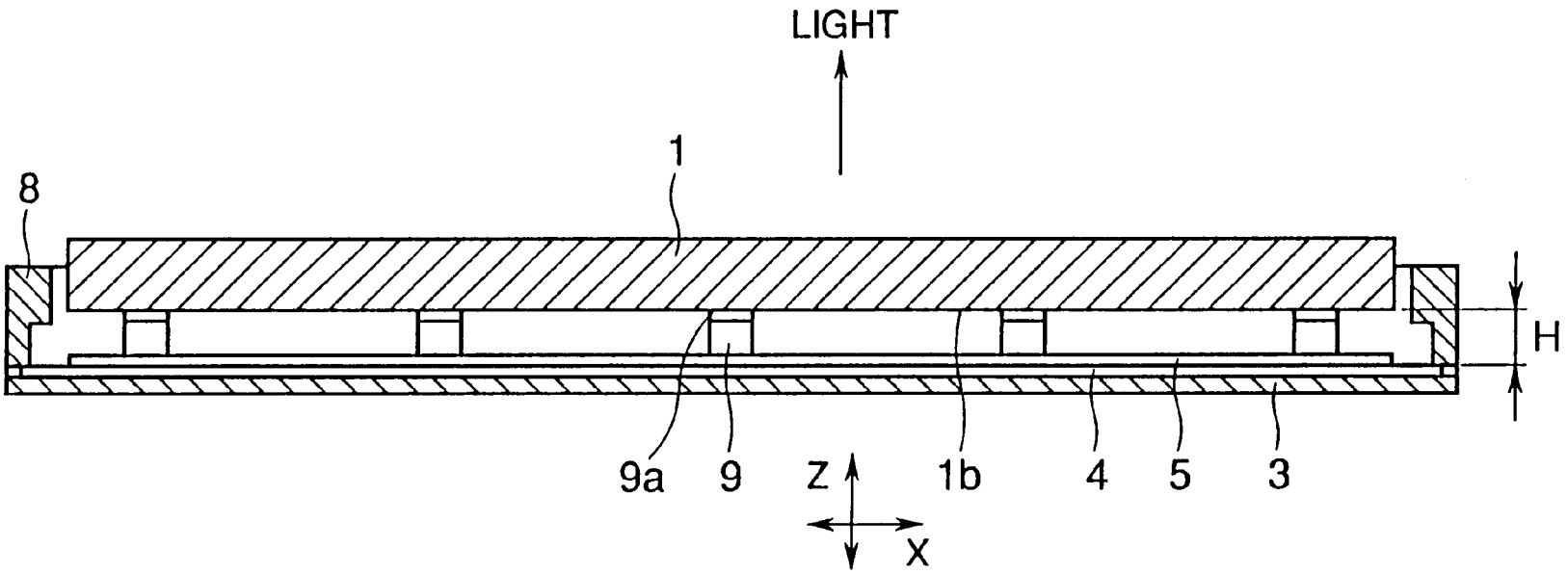
FIG. 3 is a cross-sectional view taken along lines III—III of FIG. 2.

FIG. 1 is a cross-sectional view of an LED printhead according to the first embodiment, taken along lines I—I of FIG. 2. FIG. 2 is a top view of the LED printhead of the first embodiment. FIG. 3 is a cross-sectional view taken along lines III—III of FIG. 2.

Referring to FIG. 1, an LED array unit 2 includes a printed circuit board 4, LED chips 5, driver ICs 6, and bonding wires 7. There are a plurality of LED chips (e.g., 40 chips) 5 and corresponding driver ICs (e.g., 40 ICs) 6 mounted on the printed circuit board 4. The LED chips 5 are aligned in line on the circuit board 4. Each of the LED chips 5 has a plurality of light emitting diodes (LEDs) therein, for example, 64 diodes aligned in line. The driver ICs 6 are electrically connected to the LED chips 5 by bonding wires 7 and drive the corresponding LED chips 5 so that the LEDs 5 emit light.

An SLA 1 longitudinally extends and is disposed over the line of LED chips 5 so that light emitted from the LEDs is coupled into the SLA 1 and is formed into of a line of the images of the LEDs on the photoconductive body, not shown.

The base 3 is made of a metal sheet and is generally U-shaped. Use of a mold makes it possible to manufacture such a structure in a large quantity with very little or no dimensional variations. The mold can be made with high accuracy and therefore the base 3 can be manufactured with highly controlled straightness.

As shown in FIG. 2, the holder 8 longitudinally extends and has a narrow, elongated hole 8*b* extending in a longitudinal direction of the holder 8 to receive the SLA 1 inserted thereinto. The holder 8 is molded from an engineering plastics material such as polycarbonate.

As shown in FIGS. 1 and 3, the SLA supporting member 9 is in the shape of a small block or piece. The SLA supporting member 9 includes a first reference 9*d* that abuts the surface of the printed circuit board 4, and a second reference 9*a* that abuts the lens surface of the SLA 1 to hold the SLA 1 in position. Just like the holder 8, the SLA supporting member 9 is made of an engineering plastics material such as polycarbonate. The SLA supporting member 9 determines a distance H between the surface of the printed circuit board 4 and the SLA 1 (referred to as "height H of SLA" hereinafter). There are five SLA supporting members 9, which are disposed along the length of the holder 8 and engage the end surface of the SLA 1 with which light incidence surfaces of the rod lenses are flush. Many more SLAs 1 may be used as required.

The height of the LED chips 5 determines a distance between the surfaces of the LEDs and the surface of the printed circuit board 4. The height of the LED chips 5 is closely controlled. Therefore, there is a certain relationship between the height H and a distance K from the surfaces of the LEDs 5 to the lower end surface of the SLA 1. Thus, once the height H is determined, the distance K can be determined. Therefore, the surface of the printed circuit board 4 can be used as a reference so that the positions of the surface of LEDs and the SLA 1 are determined with respect to the surface of the printed circuit board 4.

The SLA 1 is held in position as follows:

Referring to FIGS. 1 and 2, the holder 8 has opposed inner walls 8*e* and 8*f* that extend in a longitudinal direction of the holder 8 to define the hole 8*b* therebetween. The wall 8*f* has a plurality of springs 8*a* (e.g., five springs) formed thereon and the wall 8*g* has cutouts 8*b* formed therein to which the plurality of SLA supporting members 9 (e.g., five of them) are marginally slidably inserted. The holder 8 holds the LED array unit 2 at the bottom portion of the LED unit array 2. The entire structure of the holder 8 is received in the base 3 and held in place.

As shown in FIG. 1, the holder 8 and the base 3 are assembled together by clamp springs, not shown, so that the printed circuit board 4 of the LED array unit 2 is sandwiched between the holder 8 and the base 3 and pressed downward against an inner bottom surface Sz of the base 3. The base 3 has a higher rigidity against a bending force than the holder 8 and experiences little or no deformation. Pressing the SLA 1 against projections 9*a* formed on the SLA supporting members 9 causes all of the SLA supporting members 9 to abut the surface of the printed circuit board 4. The base 3 has two opposed side walls 3*a* and 3*b* which rise at right angles from the bottom surface Sz. The forces of the springs 8*a* act on the SLA 1 to urge the SLA supporting members 9 against the inner surface SY of the wall 3*b*. The SLA supporting members 9 are sandwiched between the SLA 1 and the inner surface SY of the side wall 3*b* and held firmly due to the friction between their contact surfaces, while also being pressed against the printed circuit board 4.

The springs 8*a* need not be formed in one piece construction with the holder 8 as shown in FIG. 1 but may be, for example, single resilient parts separate from the holder 8. The SLA 1, holder 8, and SLA supporting members 9 are finally bonded together by an adhesive, not shown, for a fixed structure.

The use of the SLA supporting members 9 of the same size ensures the height H at the location of each SLA supporting member 9, so that the SLA 1 is held parallel with the surface of the printed circuit board 4. As mentioned previously, the base 3 can be manufactured with a high straightness and therefore the bottom surface Sz of the base 3 is also highly straight and flat. Thus, the bottom surface Sz prevents the printed circuit board 4 and the SLA 1 from warping in the direction shown by arrow Z. The use of the SLA supporting members 9 of the same size also ensures that the SLA 1 is held at the same distance D from the inner surface Sy at the location of each SLA supporting member 9, preventing the SLA 1 from warping in a plane perpendicular to the direction shown by arrow Z.

The structure of the SLA supporting member 9 will now be described in detail and subsequently the manner in which the SLA supporting members 9 are mounted to the holder.

Figure 4:
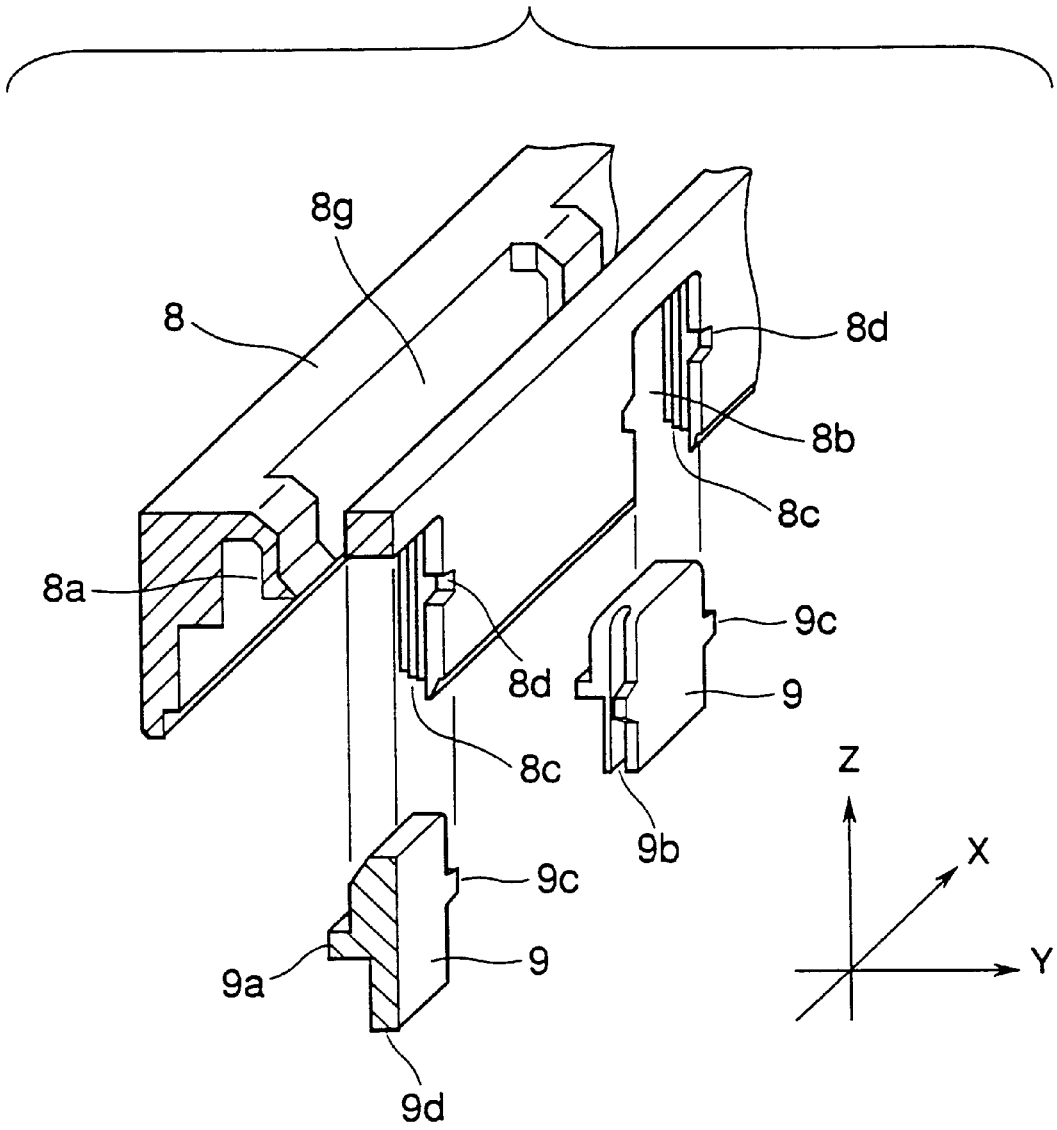
FIG. 4 is a perspective view of the holder 8 and SLA supporting members 9.

FIG. 4 is a fragmentary perspective view of relevant portions of the holder 8 and SLA supporting members 9.

Fix. 5 is an expanded fragmentary perspective view of the holder 8 and the cutout 8*b,* looking obliquely upward from the printed circuit board side.

Figure 6:
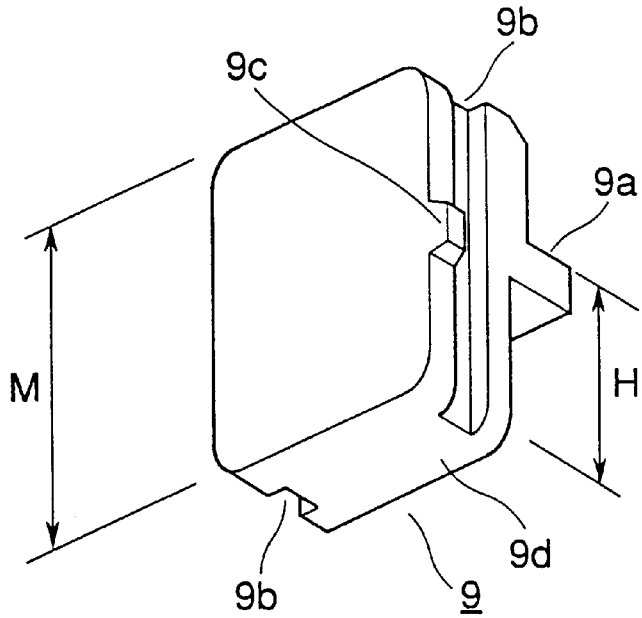
FIG. 6 is a perspective view of the SLA supporting member, looking obliquely upward from the printed circuit board side.

FIG. 6 is a perspective view of the SLA supporting member 9, looking obliquely upward from the printed circuit board side.

Figure 7:
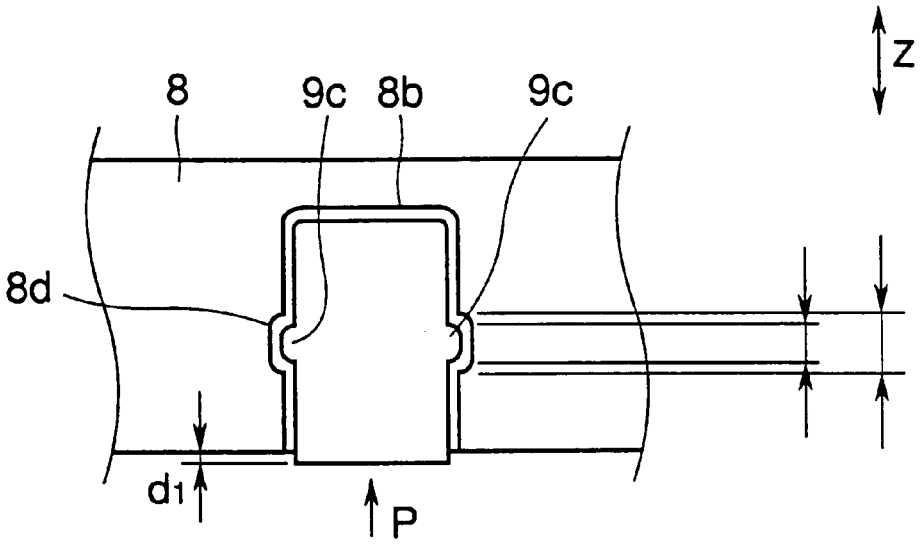
FIG. 7 is a side view of the holder, illustrating the SLA supporting member 9 when it is assembled to the holder 8.
Figure 8:
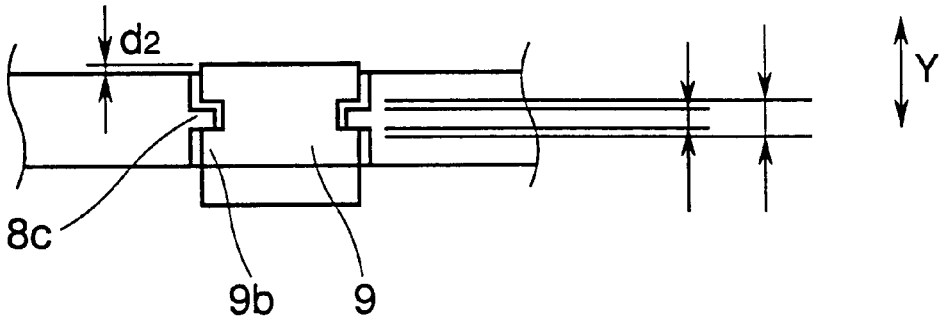
FIG. 8 is a bottom view of the holder of FIG. 7.

FIGS. 7 and 8 illustrate the SLA supporting member 9 when it has been assembled to the holder 8. FIG. 7 is a side view and FIG. 8 is a bottom view as seen in a direction shown by arrow P of FIG. 7.

Figure 5:
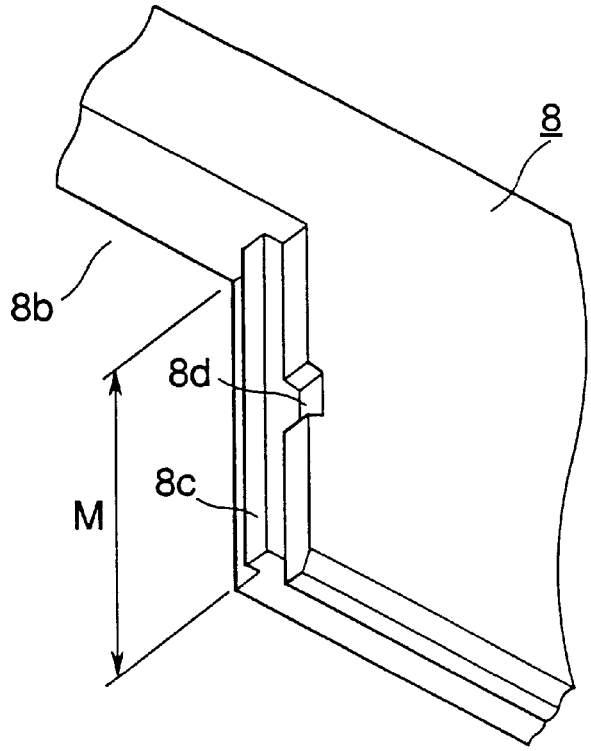
FIG. 5 is a fragmentary perspective views of the holder 8 and the tout 8*b,* looking obliquely upward from the printed circuit board side.

Referring to FIGS. 4 and 5A–5B, the holder 8 is formed with cutouts 8*b* at locations where the SLA 1 is supported by the SLA supporting members 9. The SLA supporting members 9 are small blocks or pieces and are inserted into the cutouts 8*b*.

Specifically, as shown in FIG. 8, the holder 8 has guides 8*c* that define the cutout 8*b*. The SLA supporting member 9 is formed with opposed grooves 9*b* in which the guides 8*c* slide. The groove 9*b* has a width larger than the width of the guide 8*c*, allowing some free movement of the SLA supporting member 9 relative to the holder 8 in the direction shown by arrow Y.

As shown in FIG. 7, the holder 8 is formed with recesses 8*d* and the SLA supporting members 9 are formed with opposed projections 9*c* loosely complementary to the recesses 8*d*. The opposed recesses 8*d* receive the projection 9*c* therebetween once the SLA supporting member 9 has been fully inserted into the cutout 8*b*, preventing the SLA supporting member 9 from accidentally dropping out of the cutout 8*b*. The width of the recess 8*d* is somewhat larger than that of the projection 9*c*, allowing some free movement of the SLA supporting member 9 in the direction shown by arrow Z.

The grooves 9*b* and projections 8*c* maybe reversed. For example, grooves similar to the grooves 9*b* may be formed in the holder 8 and projections similar to the projection 8*c* may be formed on the SLA supporting member 9. As shown in FIG. 7, the projection 9*c* of the SLA supporting member 9 loosely fits into the cutout 8*c* in the holder 8, so that the SLA supporting member 9 is extendable by a short distance dl in the direction shown by arrow Z. The distance dl ensures that the SLA supporting member 9 abuts the surface of the printed circuit board 4. As shown in FIG. 8, the groove 9*b* of the SLA supporting member 9 loosely fits to the guide 8*c* of the holder 8, so that the SLA supporting member 9 is extendable by a short distance d2 in the direction shown by arrow Y. The distance d2 ensures that the SLA supporting member 9 abuts the inner surface SY of the side wall 3*b*. The loosely-fitting construction also alleviates the required dimensional accuracies of the cutout 8*b*, guide 8*c*, and cutout 8*b* and allows the individual SLA supporting members 9 to support the SLA 1 independently of each other.

Since the SLA supporting members 9 are supported by the holder 8 with some free movement in the directions shown by arrows Y and Z, the relative positions of the SLA supporting members 9 are not seriously affected by the dimensional errors of the holder 8 which may result from warp and distortion inherent to resin molding. This construction is advantageous in that upon assembling the SLA supporting members 9 into the holder 8, the holder 8 and SLA-supporting members 9 can be handled as an integral assembly after they have been assembled, facilitating the assembly of the printhead.

In the present invention, the SLA supporting member 9 is in the shape of a small block. Therefore, if the SLA supporting member 9 is to be molded from a resin material, the deformation of the SLA supporting member 9 due to distortion and warp is negligibly small since the SLA supporting member 9 is sufficiently small in size.

A polycarbonate material has a mold shrinkage factor of about 0.3% though there are some variations. If the shrinkage of a shaped article is to be less than 15 $\mu$m, the maximum possible size of the shaped article is given by the following equation.

$$15\,\mu m / 0.3\,\% = 5000\,\mu m$$
$$= 5\,mm$$

It is sufficient for the optical head of the present invention if an error of the height of the SLA supporting member 9 can be within 15 $\mu$m. Thus, if the maximum dimension of the SLA supporting member 9 is less than 5 mm, then the variations in shrinkage thereof need not be considered.

The warp of a shaped article is rather small. For example, from the past experience, the warp of the holder 8 in the longitudinal direction is known to be only about 0.2%. Thus, if the warp of a shaped article is to be less than 15 $\mu$m, the maximum possible size of the shaped article is given by the following equation.

$$15\,\mu m / 0.2\,\% = 7500\,\mu m$$
$$= 7.5\,mm$$

In other words, if the maximum length of the SLA supporting member 9 in the direction shown by arrow X in FIG. 2 is less than 7.5 mm, then the variations in the warp of a molded SLA need not be considered.

Thus, the SLA supporting member 9 should be less than 5 mm high and less than 7.5 mm long.

As described above, forming the SLA supporting member 9 in the shape of a sufficiently small block allows adjustment of the height H of the SLA 1 within a predetermined error range. The printed circuit board 4 can be straight enough since it is assembled to the base 3 that can be manufactured with a sufficient straightness. The SLA 1 is supported by the SLA supporting members 9 so that portions of the SLA 1 supported by the SLA supporting members 9 are at the same height H with respect to the surface of the printed circuit board 4. Thus, the SLA 1 can be supported very straight. Therefore, both the SLA 1 and the row of the LEDs on the printed circuit board 4 are straight, so that the line of focussed images of the LEDs on the photoconductive body are straight. This allows formation of a good electrostatic latent image across the length of the photoconductive body.

Second embodiment

The refractive index of the fiber glass used in the SLA varies depending on manufacturing lots, resulting in variations in conjugate length TC, i.e., distance between the LEDs and the images of the LEDs focussed on the photoconductive body. The LED printhead is positioned to oppose the photoconductive body so that the distance between the surfaces of the LEDs and the photoconductive body is equal to a fixed conjugate length Tc0 of the SLA 1. If the conjugate length TC of the SLA deviates from the fixed conjugate length $TC_0$, the images of LEDs cannot be sharply focussed on the photoconductive body.

Therefore, in order to set the conjugate length of the SLAs 1 to the fixed conjugate length $TC_0$, physical lengths L of SLAs 1 in the direction of conjugate length are adjusted when they are manufactured. In other words, there is no significant variation in conjugate length TC of the SLA 1 from lot to lot though the physical length L of the SLAs varies from lot to lot. The physical length L varies in the ranges of $L_{00}$±0.5 mm, Lo being a fixed design value. The maximum variation $\delta$ is ±0.5 mm.

In the present invention, the SLA 1 is positioned by allowing its outer corner to engage the projection 9*a* of the SLA supporting members 9 assembled to the holder 8. If the length L of the SLA in the direction shown by arrow Z changes, then the center of the SLA 1 in the direction shown by arrow Z deviates by ΔL from the mid point of the distance or conjugate length TC between the surfaces of LEDs and the surfaces of the photoconductive body. The maximum deviation AL is half the variation δ=±0.5 mm, i.e., ±0.25 mm.

FIGS. 9A–9D are a model representation illustrating the assembly procedure of an LED printhead according to the second embodiment, taken along lines IX—IX of FIG. 2.

Referring to FIG. 6, the LED printhead of the second embodiment differs from that of the first embodiment in the construction of the SLA supporting members 901–905.

FIG. 10 shows a table which lists the SLA supporting members 901–905. Referring to FIG. 10, SLA 1 has a fixed length of $L=L_0=8.41$ mm and a conjugate length of $TC_0=18.7$ mm.

The SLA1 has a variation δ of ±0.5 mm (i.e., Max. 1 mm) as described previously. Therefore, the sizes of the SLA1 in the direction shown by arrow Z is divided into five in increments of 0.2 mm, thus five different SLA supporting members 901–905 are prepared with the height H in increments of 0.1 mm. By way of example, the SLA supporting member 901 will be described.

Since the distance between the surfaces of the LEDs of the LED chips 5 and the surface of the printed circuit board 4 is closely controlled, a change of 0.1 mm in height H directly causes a change of 0.1 mm in distance K.

The SLA supporting members 901, 902, 903, 904, and 905 has distances K of 4.95 mm, 5.05 mm, 5.15 mm, 5.25 mm, and 5.35 mm, respectively. The SLA supporting members 901–905 are substantially the same as the SLA supporting member 9 of the first embodiment except for the height H. The SLA supporting members 9 are held by the holder 8.

The manufacturing steps will now be described.

Figure 9A:
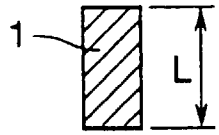
FIGS. 9A–D are a model representation illustrating the assembly procedure of an LED printhead according to the second embodiment, taken along lines IX—IX of FIG. 2.
Figure 9B:
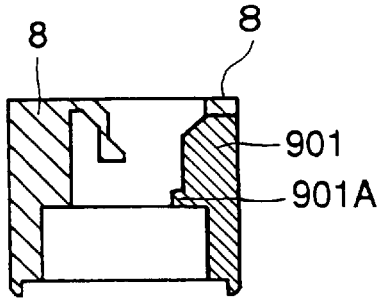
Figure 9C:
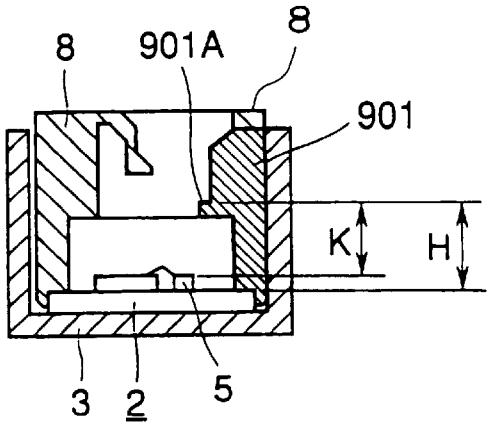
Figure 9D:
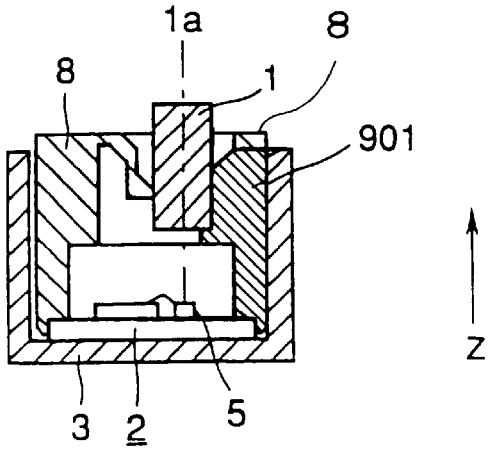

The dimension L of the SLA 1 as shown in FIG. 9A is measured. One 901 of the SLA supporting members 901–905 is selected from the table shown in FIG. 10 in accordance with the dimension L of the SLA 1 and mounted to the holder 8 as shown in FIG. 9B. The holder 8 holds the LED array unit 2 and is received in the base 3 as shown in FIG. 9C. Then, as shown in FIG. 9D, the SLA 1 abuts the SLA projection 901*a* of the SLA supporting member 901 and is held straight in the direction shown by arrow Z.

It is known that the maximum variation of the dimension of SLA1 in the direction shown by arrow Z is ±0.5 mm. Thus, a deviation of the center ΔL is ±0.25 mm. In order to maintain the center of the SLA 1 at a fixed position relative to the surface of the printed circuit board 4, the height H of an SLA supporting member must be adjusted within ±0.25 mm.

A most appropriate SLA supporting member 901 is selected from five different SLA supporting members 901–905 shown in FIG. 10 so as to offset the differences between the measured dimension L and the fixed length $L_0$.

For example, if the SLA 1 has a dimension $L=8.41+\delta$ mm and 0.3 mm$<\delta\leqq$0.5 mm, the supporting member 901 is selected. When the supporting member 1 is supported by the supporting member 901, the distance K is 4.95 mm and the distance (L/2)+K between the center of the SLA1 and the LEDs is as follows:

$$\begin{aligned}(L/2)+K &= (4.95+4.355) \text{ to } (4.95+4.455)\\ &= 9.305 \text{ to } 9.405\\ &= 9.355 \pm 0.05 \text{ mm}\\ &\approx (18.7/2) \pm 0.05 \text{ mm}\\ &= TC_0/2 \pm 0.05 \text{ mm}\end{aligned}$$

Thus, for example, if the dimension L of an SLA 1 is $L=8.41+\delta$ mm and 0.1 mm$\leqq$0.3 mm, the SLA supporting member 902 is selected.

Using the SLA supporting member 902, the distance K is 5.05 mm, and the distance (L/2)+K between the center of the SLA 1 and the LEDs is given as follows:

$$\begin{aligned}(L/2)+K &= (8.51/2)+5.05 \text{ to } (8.71/2)+5.05\\ &= 9.305 \text{ to } 9.405\\ &= 9.355 \pm 0.05 \text{ mm}\\ &\approx (18.7/2) \pm 0.05 \text{ mm}\\ &= TC_0/2 \pm 0.05 \text{ mm}\end{aligned}$$

For other values of δ, the TC/2 is also $TC/2\approx(18.7/2)+0.05$ mm.

Figure 11:
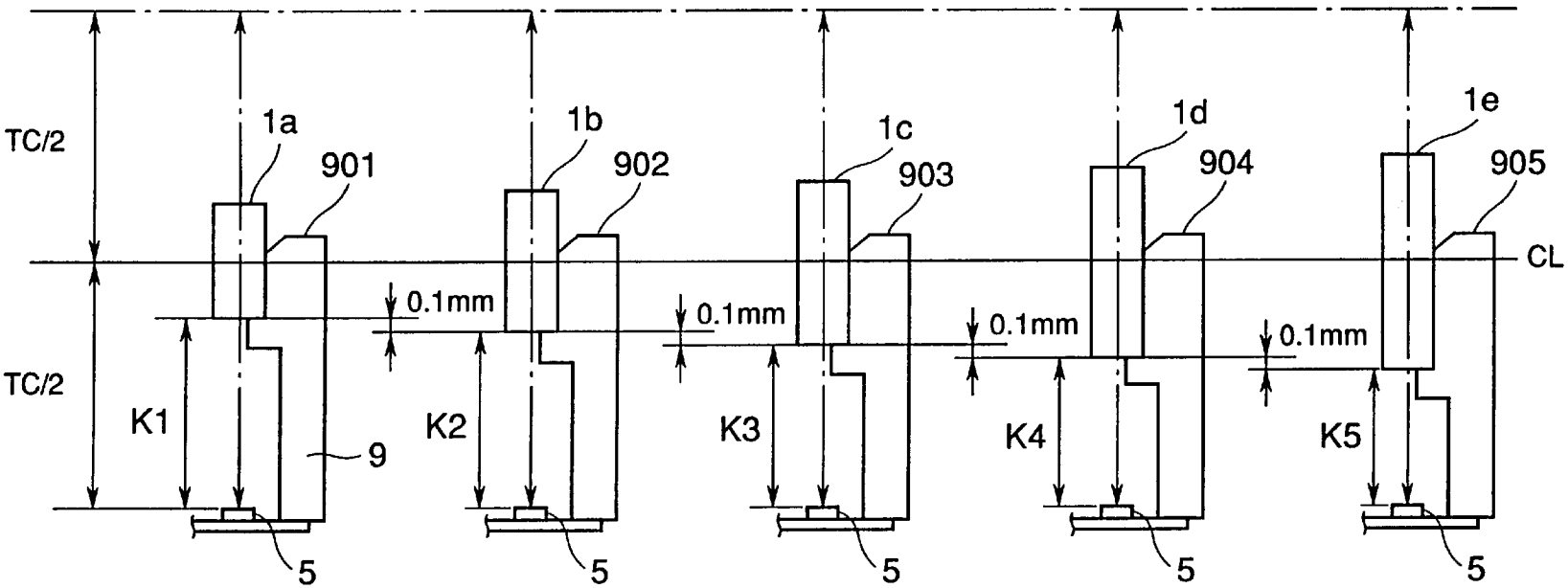
FIG. 11 illustrates SLAs 1*a*–1*e* with different dimension L supported on SLA supporting members 901–905 having different heights H so that the center of the SLAs are accurately held at TC/2.

FIG. 11 illustrates SLAs 1*a*–1*e* with different dimension L supported on SLA supporting members 901–905 having different heights H so that the center of the SLAs are accurately held at $TC_0/2$.

The second embodiment allows the deviation ΔL to be within ±0.05 mm.

The influence of an error of ΔL=±0.05 mm will be described.

Figure 12:
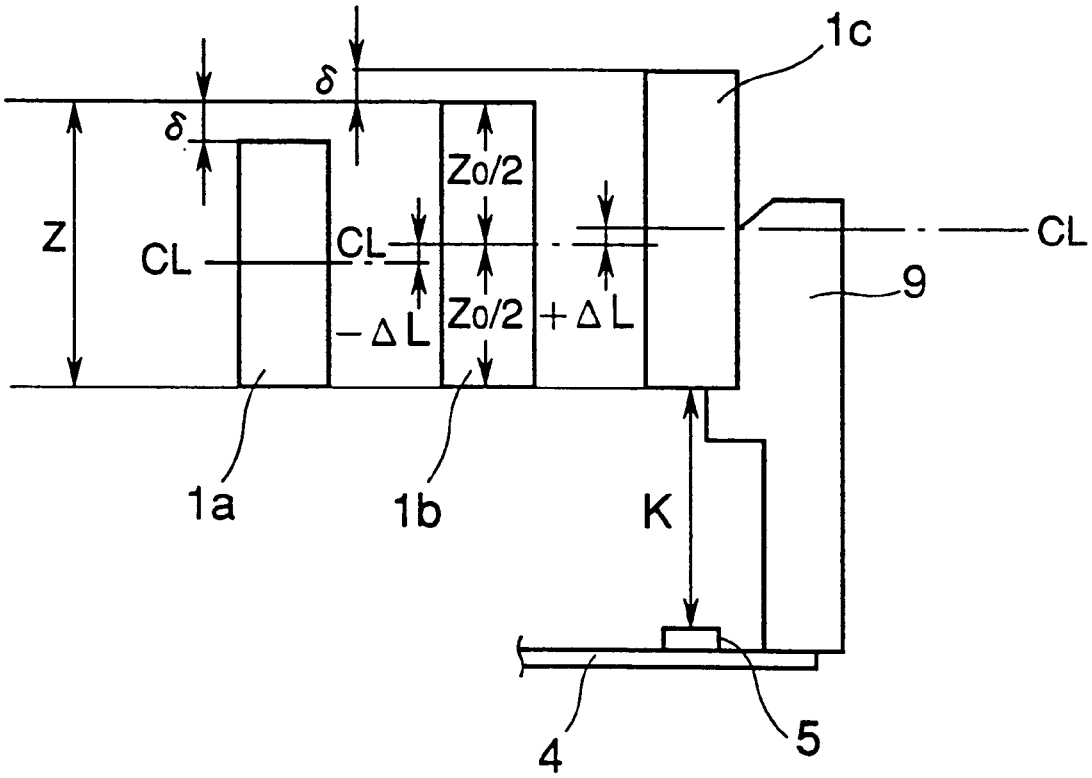
FIG. 12 illustrates three SLAs 1*a,* 1*b,* and 1*c* having different dimension in the direction shown by arrow Z.

FIG. 12 illustrates three SLAs 1*a*, 1*b*, and 1*c* having different dimensions in the direction shown by arrow Z. The SLA 1*b* has a standard value $L_0$ and SLA 1*a* and 1*c* have values $L_0-\delta$ and $L_0+\delta$, respectively.

Figure 13:
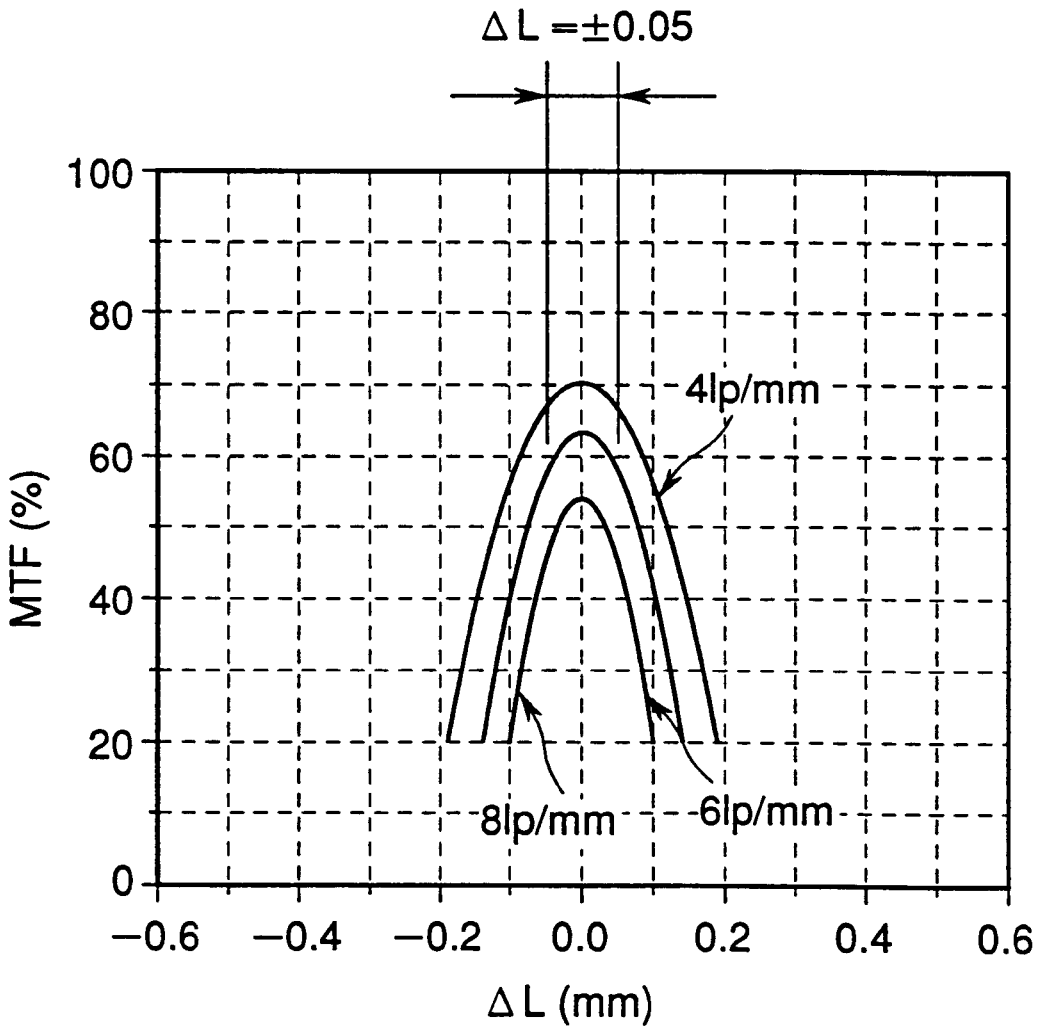
FIG. 13 illustrates the relationship between the deviation ΔL and MTF of the SLA 1.

FIG. 13 illustrates the relationship between the deviation ΔL and MTF (Modulation Transfer Function) of the SLA 1. MTF refers to a characteristic value that represents the resolution of a lens. An image formed by the SLA 1 becomes very close to its original image as the MTF of the lens approaches 100%, depending on the spatial frequency. For example, in order to provide good images of LEDs at a resolution of 300 dpi (≈6 lp/mm), an MTF of more than 50% is required. The unit "p/mm" denotes "line pair per millimeter" which is the number of pairs of white line and black line in a millimeter.

FIG. 13 shows that if the deviation ΔL is within ±0.05 mm, the MTF for 300 dpi can be more than about 60%.

A resultant deviation ΔL in the range of ±0.05 mm is acceptable. In other words, adjusting the distance K in increments of 0.1 mm allows a line of sufficiently focussed images of LEDs to be formed on the surface of the photoconductive body.

The height H of the SLA can be adjusted across the entire length of the SLA. Therefore, the distance K can be adjusted substantially to the mid point between the surfaces of LEDs and the surface of the photoconductive body within an acceptable error range.

Third embodiment

The first and second embodiments have been described with respect to a case where the base is accurately straight. The base, however, may be subjected to warping due to careless handling during transportation and improper storage conditions. If the base is warped, the entire printhead is also warped, resulting in a curved line of the images of LEDs. The third embodiment solves this problem.

Figure 14:
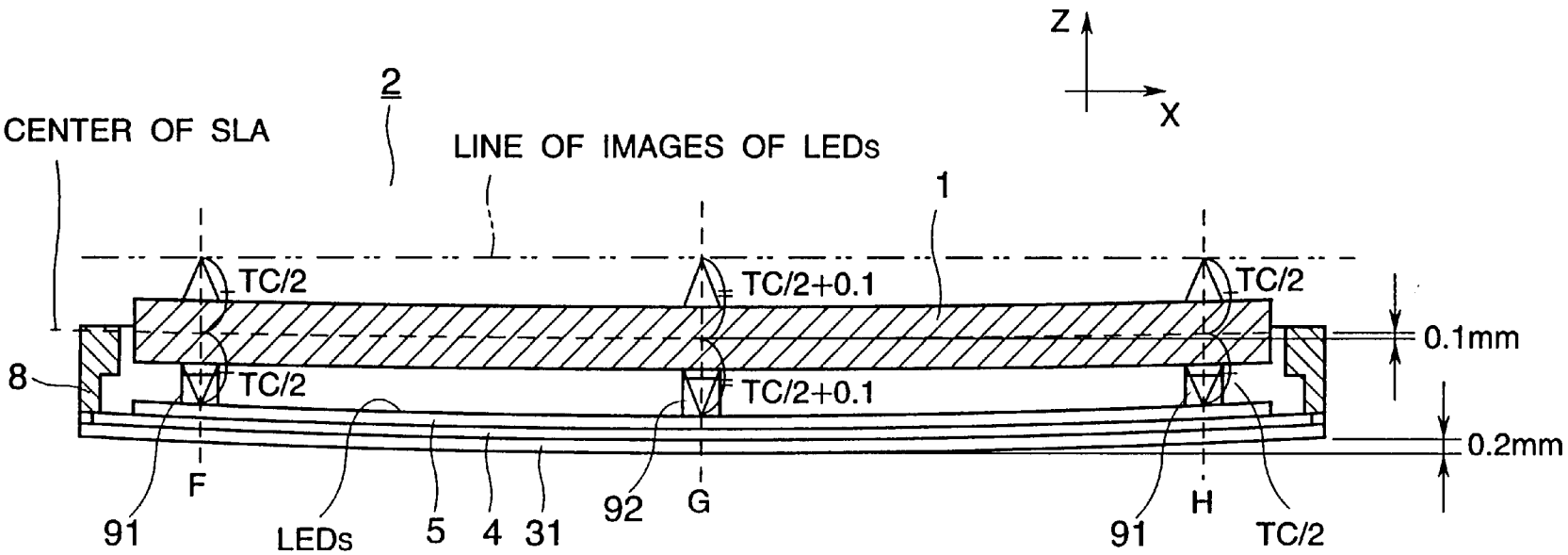
FIG. 14 is a cross-sectional side view of an LED printhead according to the third embodiment.

FIG. 14 is a cross-sectional side view of an LED printhead according to the third embodiment.

Referring to FIG. 14, the LED printhead of the third embodiment is of the same construction as the first embodiment except for the base 31 and SLA supporting plate 91 and 92.

A base 31 is U-shaped just like the base 3 of the first and second embodiments and is made by folding a sheet of metal. It is assumed that the base 31 is warped so that the middle portion of the base 31 extends outward by 0.2 mm.

SLA supporting members 91 and 92 have heights H=h0 mm and H=h0+0.1 mm, respectively, where h0 is a height of the SLA such that the center of the SLA is substantially at the mid point between the surfaces of LEDs and the surface of the photoconductive body.

The SLA supporting members 91 and 92 are of the same shape as that of the first embodiment and are held by the holder 8 just as in the first embodiment. The SLA supporting members 91 and 92 differ only in the height H thereof. In the third embodiment, the holder 8 has the SLAs mounted at three locations of it.

The SLA 1 has a dimension Z0 in the direction shown by arrow Z. The SLA 1 is held in position with respect to the holder just as in the first embodiment.

As shown in FIG. 14, the base 31 is warped by 0.2 mm and the printed circuit board 4 of the LED array unit 2 is also warped by 0.2 mm along the base 31. In other words, the base 31 and the printed circuit board 4 outwardly extend by 0.2 mm at position G.

The LED array unit 2 is h0 mm high at positions F and H relative to the printed circuit board 4 and h0+0.1 mm high at position G. In other words, the SLA 1 is warped by 0.1 mm relative to the bottom of the base 31.

At positions F and H, the height H of the SLA 1 is h0 and therefore the distance from the surfaces of LEDs to the mid point of the SLA 1 is TC/2. AS shown in FIG. 14, the line of the focussed images of LEDs lies at a distance opposite to the LEDs with respect to the mid point of the SLA. At points F and H, an actual distance *TC between the surfaces of LEDs and the images of LEDs on the photoconductive body is given by *TC=(TC/2)×2.

However, the height of the SLA 1 is 0.1 mm higher at point G than at points F and H and therefore the distance from the surfaces of LEDs to the focussed images of the LEDs is given by the following equation.

$$^{*}TC = \{(TC/2) + 0.1\} \times 2$$

$$= TC + 0.2\,\text{mm}$$

That is, the images of LEDs formed at position G are 0.2 mm further away from the surfaces of the LEDs than those formed at positions F and H, thus offsetting the warp (=0.2 mm) of the base 31 so that the line of the images of LEDs is substantially straight.

In this manner, a warp of the base 31 and a difference between *TC and TC are always of the same magnitude but opposite in direction.

Figure 15A:
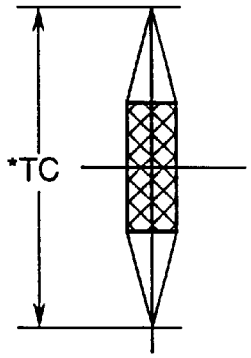
FIGS. 15A–15B illustrates the relationship between *TC and MTF.
Figure 15B:
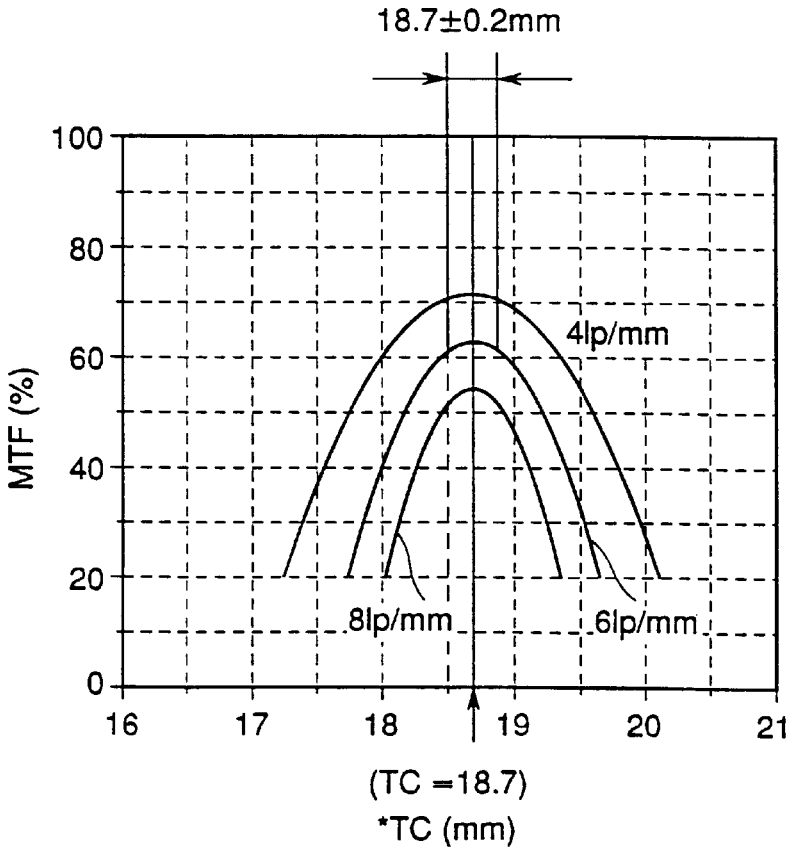

FIGS. 15A–15B illustrate the relationship between *TC and MTF. Referring to FIGS. 15A–15B, if the *TC is within the range of TC±0.2 mm, then the MTF of more than about 60% can be ensured for a spatial frequency of 6 lp/mm (300 dpi).

A plurality of SLA supporting members with different heights are prepared. The warp of the base 31 can be known by measuring it before the SLA 1 is assembled into the printhead.

An SLA supporting member is selected from the plurality of SLA supporting members, the selected SLA supporting member having a height H such that the warp of the base 31 is offset by a distance equal to half the warp of the base 31.

Therefore, there will be no images out of focus in any parts of the line of the images of LEDs formed on the surface of the photoconductive body, so that good electrostatic latent images can be formed on the photoconductive body.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An optical printhead, comprising:

a circuit board;

a plurality of light emitting elements mounted in line on said circuit board, the light emitting elements having a predetermined height;

a rod lens array longitudinally extending and forming images from the light emitting elements such that the images and the light emitting elements form pairs of conjugate points with respect to said rod lens array;

a holder holding said rod lens array relative to said plurality of light emitting elements; and a plurality of supporting members mounted to said holder at a plurality of locations along a length of said rod lens array and positioning said rod lens array relative to said circuit board, each of said plurality of supporting members having a first reference portion and a second reference portion spaced apart from the first reference portion by a predetermined distance, the first reference portion abutting a first predetermined part of said rod lens array and the second reference portion abutting a second predetermined part of said circuit board so that said rod lens array forms the images from the light emitting elements on a straight line.

2. The optical printhead according to claim 1, wherein said supporting members are mounted to said holder so that said supporting members are marginally displaceable relative to said holder before said holder and said supporting members have been finally assembled into the optical printhead.

3. The optical printhead according to claim 2, further comprising a base member that is more rigid than said circuit board and holds said circuit board flat, wherein said plurality of supporting members are positioned such that said plurality of supporting members abut said circuit board.

4. The optical printhead according to claim 1, wherein said lens supporting members have a same distance between the first and second reference portions.

5. The optical printhead according to claim 1, wherein when distances between said rod lens array and said printed circuit board are different at the plurality of locations, at least one of said supporting members has the first reference portion and second reference portion spaced apart such that a portion of said rod lens array is offset and held relative to said circuit board at a distance of half a difference in distance between said rod lens array and said printed circuit board.

6. The optical printhead according to claim 1, wherein the predetermined distance is the same for each of said supporting members.

7. An optical printhead, comprising:

a circuit board;

a plurality of light emitting elements mounted in line on said circuit board, the light emitting elements having a predetermined height;

a rod lens array longitudinally extending and forming images from the light emitting elements such that the images and the light emitting elements form pairs of conjugate points with respect to said rod lens array;

a holder holding said rod lens array relative to said plurality of light emitting elements; and a plurality of supporting members mounted to said holder at a plurality of locations along a length of said rod lens array and positioning said rod lens array relative to said circuit board, each of said supporting members having a first reference portion and a second reference portion spaced apart from the first reference portion, the first reference portion abutting a first predetermined part of said rod lens array and the second reference portion abutting a second predetermined part of said circuit board so that said rod lens array forms the images of the light emitting elements on a straight line;

wherein said supporting members are mounted to said holder such that said supporting members are marginally displaceable relative to said holder before said holder and supporting members have been finally assembled into the optical printhead.

8. The optical printhead according to claim 7, further comprising a base member that is more rigid than said circuit board and holds said circuit board flat, wherein said plurality of supporting members are positioned such that said plurality of supporting members abut said circuit board.

9. The optical printhead according to claim 7, further comprising a base member that is more rigid than said circuit board, said base member having a first surface on which said circuit board is held flat and a second surface substantially perpendicular to the first surface, wherein said plurality of supporting members are held to abut the second surface.

10. The optical printhead according to claim 7, wherein the predetermined distance is the same for each of said supporting members.

* * * * *